United States Patent [19]

Hallmark

[11] 4,089,381

[45] May 16, 1978

[54] CHAMBER ISOLATOR AND SEALING MEANS FOR BOREHOLE PERFORATING TOOLS

[75] Inventor: Bobby J. Hallmark, Fort Worth, Tex.

[73] Assignee: Gearhart-Owen Industries, Inc., Fort Worth, Tex.

[21] Appl. No.: 661,796

[22] Filed: Feb. 26, 1976

[51] Int. Cl.[2] ..... E21B 43/117

[52] U.S. Cl. ..... 175/4.6; 102/21.6; 102/24 HC; 175/4.55

[58] Field of Search ..... 175/4.55, 4.6, 4.52, 175/4.53; 102/21.6, 24 HC; 166/299, 177

[56] References Cited

U.S. PATENT DOCUMENTS

| | | | |
|---|---|---|---|
| 2,655,619 | 10/1953 | Neal | 175/4.55 X |
| 2,662,474 | 12/1953 | Turechek et al. | 175/4.6 |
| 3,010,396 | 11/1961 | Coleman | 175/4.55 |
| 3,043,379 | 7/1962 | Porter et al. | 175/4.6 X |
| 3,327,792 | 6/1967 | Boop | 175/4.55 X |
| 3,528,511 | 9/1970 | Boop et al. | 175/4.55 |
| 3,528,512 | 9/1970 | Boop | 175/4.55 |
| 3,768,408 | 10/1973 | Hallmark | 175/4.55 X |

FOREIGN PATENT DOCUMENTS

| | | | |
|---|---|---|---|
| 258,201 | 12/1969 | U.S.S.R. | 175/4.55 |

*Primary Examiner*—Stephen J. Novosad
*Attorney, Agent, or Firm*—Wm. T. Wofford; James M. Peppers

[57] ABSTRACT

Improved end closures for shaped charge unit chambers in borehole perforating tools have flanged peripheral portions to be clamped in the threaded joint when sidewalls of adjacent chambers are threadedly joined. Also disclosed are sealing means for conductor wires passing through the end closures, which sealing means involves means for compressing and deforming the conductor insulation so that the conductors with their insulation sealingly occupy a predetermined space between surfaces of cooperating compressing and deforming means.

15 Claims, 5 Drawing Figures

CHAMBER ISOLATOR AND SEALING MEANS FOR BOREHOLE PERFORATING TOOLS

FIELD OF THE INVENTION

The invention relates to borehole perforating tools and more particularly to improved chamber isolator and sealing means for such tools.

BACKGROUND OF THE INVENTION

It is conventional practice to make up a perforating gun utilizing one or more selective firing units, with each selective firing unit controlling the ignition of the shaped charge units that are disposed in each of a plurality of separate chambers. It is necessary tht the ignition of the shaped charge unit or units in one chamber will not adversly affect the ignition of the shaped charge unit or units in other chambers. Consequently, it is necessary that the shaped charge unit or units of a particular chamber be effectively isolated and sealed relative to the next adjacent chamber.

Prior art practices are exemplified by my U.S. Pat. No. 3,768,408 and B. J. Boop, et al U.S. Pat. Nos. 3,528,511 and 3,528,512. In these patents, the subs that are used as chamber isolators are relatively heavy, bulky and expensive, and the arrangement utilized to handle and seal the ignition wires that must be brought from the selective firing unit to each chamber are not entirely satisfactory.

An object of the invention is to provide improved chamber isolator and sealing means for borehole perforating tools.

Another object of the invention is to provide improved borehole perforating tool chamber isolator means that are relatively inexpensive to manufacture, occupy relatively small space, and are susceptible to quick and easy assembly.

Another object of the invention is to provide improved arrangements for disposition and sealing of the ignition wires that lead from a borehole perforating tool selective firing unit to respective shaped charge unit chambers.

For a further understanding of the invention and further objects, features, and advantages thereof, reference may now be had to the following description, taken in conjunction with the accompanying drawings.

SUMMARY OF THE INVENTION

The invention provides an improved isolator or end closure for the shaped charge unit chambers of a borehole perforating tool. The improved end closure has a flanged peripheral portion that is simply clamped in the threaded joint when the sidewalls of adjacent chambers are threadedly joined. In a preferred embodiment, the end closure has the general shape of a disc having an integral hub protruding on one side of the disc and means for sealing conductor wires that pass through the end closure are contained within the hub. The invention also provides improved means for the disposition and sealing of said conductor wires. To carry out this aspect of the invention, the end closure is provided a central bore which accommodates a seat member, a spool member and a retainer nut. The seat and spool members have mating portions of constant transverse cross-section area, there being a space between these mating portions which has an area predetermined to substantially equal the total transverse section area of all of the conductor wires (and their insulation) that are to pass through the end closure, with the insulation on the wires being compressed and deformed so as to sealingly occupy the space above-mentioned when the spool member is sufficiently advanced toward the seat member by the threading action of the retainer nut. There is preferably provided also tapered mating portions of the seating member and spool member. In addition, there are preferably provided slots about the spool member outer end portion periphery for receiving and aiding the distribution of conductor wires about the spool member.

DESCRIPTION OF PREFERRED EMBODIMENT

Figure 1:
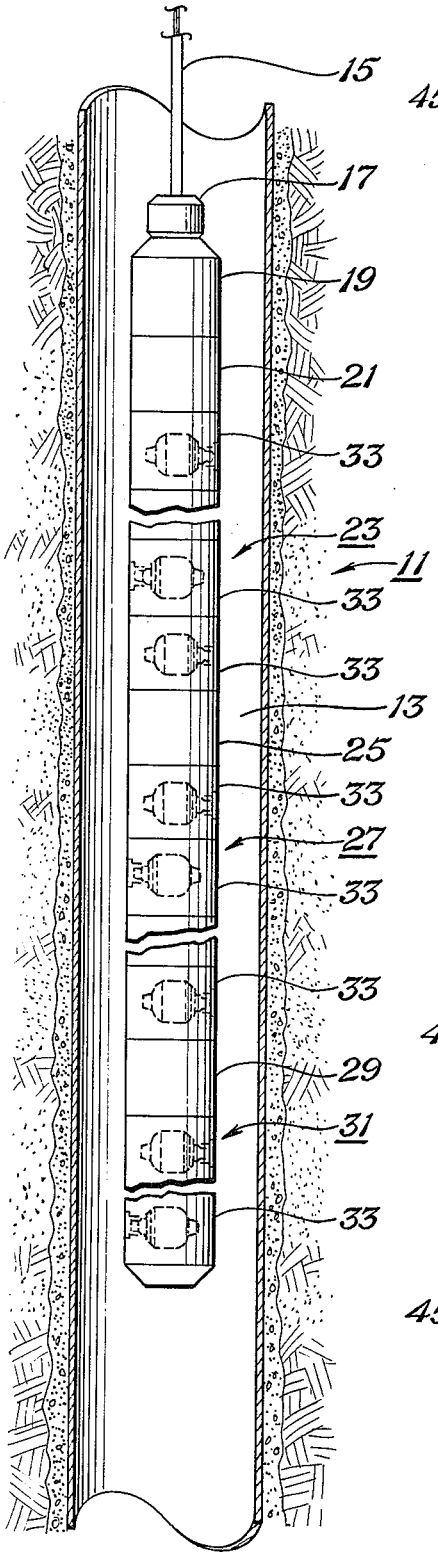
FIG. 1 is a schematic diagram of a borehole perforating tool in accordance with one embodiment of the invention, the tool being suspended in a well.

In FIG. 1 there is schematically shown a length of a typical cased well bore 11 to be perforated, with a typical borehole perforating tool 13 suspended therein by means of a wire line 15. The tool 13 assembly comprises, in order from top to bottom, a cable head 17, an adapter sub 19, a first selective firing unit 21, a first plurality of shaped charge unit chambers 23, a second selective firing unit 25, a second plurality of shaped charge unit chambers 27, a third selective firing unit 29, and a third plurality of shaped charge unit chambers 31.

With the exception of the shaped charge unit chamber isolator means and the arrangements for disposition and sealing of the ignition wires leading from the selective firing units to the respective shaped charge unit chambers, all components of the borehole perforating tool 13, as well as associated above-ground equipment, may be of a conventional type and, consequently, are not shown and described in detail herein. In particular, the selective firing units and their controls and connections may be like those disclosed in my U.S. Pat. No. 3,768,408.

In the embodiment shown, each shaped charge unit chamber contains a single shaped charge. It should be understood, however, that each shaped charge unit chamber could contain a plurality of shaped charge units, as shown in my U.S. Pat. No. 3,768,408 and in B. J. Boop, et al, U.S. Pat. Nos. 3,528,511 and 3,528,512. It should also be understood that, typically, a selective firing unit will be used for each ten shaped charge unit chambers.

Figure 2:
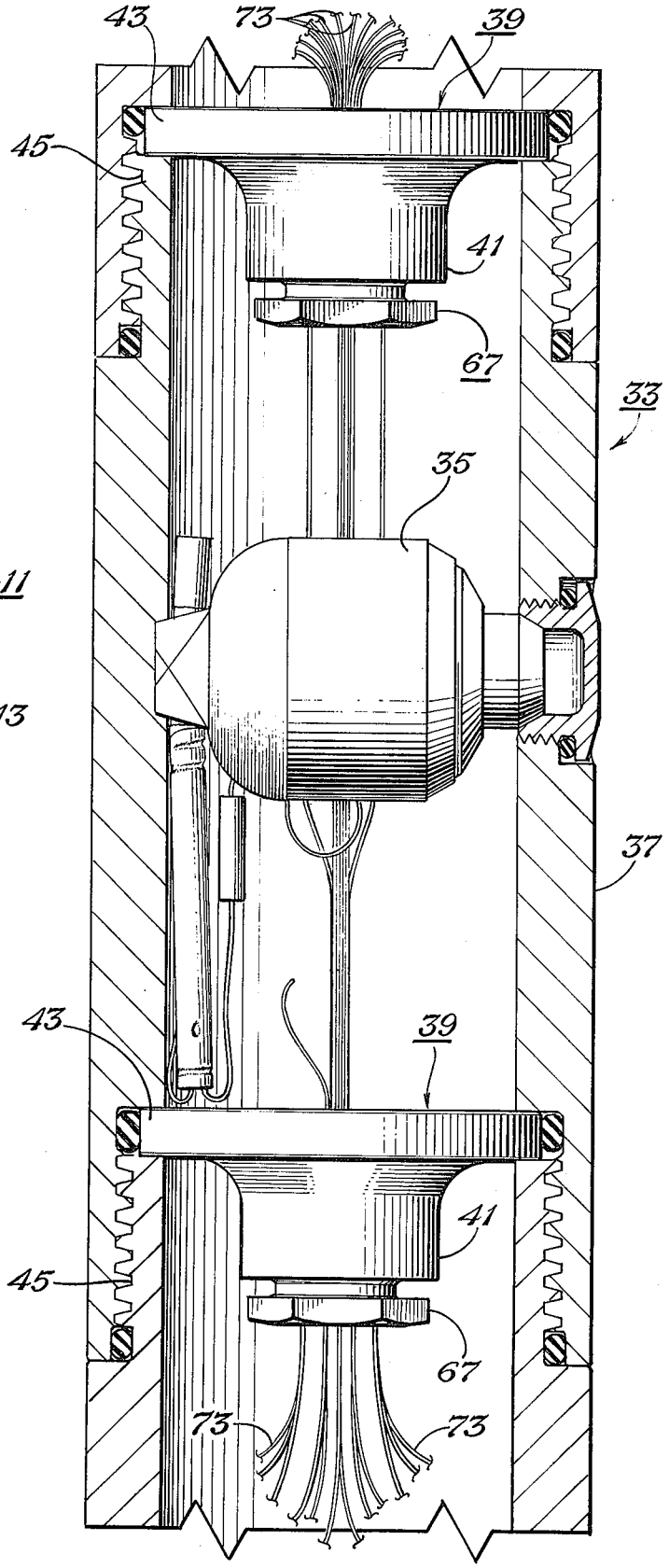
FIG. 2 is a schematic view, partially in section, showing a typical chamber with isolator and ignition wire disposition and sealing means in accordance with a preferred embodiment of the invention.

In FIG. 2, there is shown a typical shaped charge unit chamber 33 containing a single shaped charge unit 35. The chamber 33 has a cylindrical sidewall 37 which is a part of the body of the tool 13 and which is threaded at its end portions. The chamber 33 is provided with identical end closures 39 which serve to isolate the chamber 33 from adjacent chambers. In the embodiment shown, each end closure 39 has the general shape of a disc having an integral hub 41 protruding on one side of the dis. The disc peripheral portion can be termed a peripheral flange portion 43 that is clamped in the respective threaded joint 45 when the sidewalls of adjacent chambers are threadedly joined. The threaded joint 45 is sealed by suitable means, such as O-rings as shown in FIGS. 2 and 3.

Figure 3:
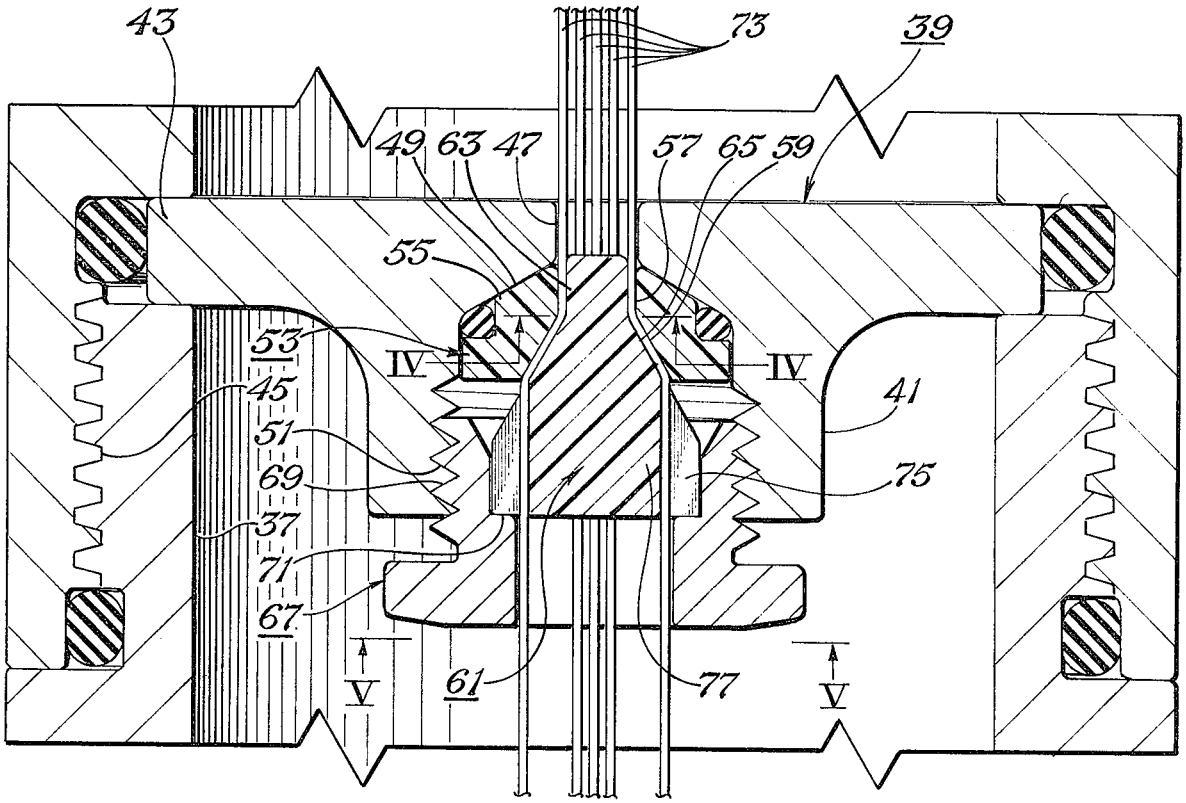
FIG. 3 is an enlarged fragmentary schematic section view, showing details of a single chamber isolator and ignition wire disposition and sealing means as installed in a borehole perforating tool.

In FIG. 3, there is shown in further detail a single chamber isolator or end closure 39 together with means permitting the passage of electrical conductor wires therethrough and means sealing the space between the conductors and the end closure to effectively isolate a chamber. More specifically, the end closure 39 is provided a central bore having an electrical conductor wire passage portion 47 merging with an enlarged seat receiving portion 49 which in turn merges with a threaded portion 51. A seat member 53 has a seating portion 55 which is shaped to conformingly engage the seat receiving portion 49 of the end closure 39. The seat member 53 has a central bore having a first portion 57 of constant transverse cross-section area merging with a tapered portion 59. A spool member 61 has a first portion 63 shaped to mate with the seat member central bore first portion 57 and merging with a tapered portion 65 shaped to mate with the seat member central bore tapered portion 59. A retainer nut 67 has a threaded portion 69 which engages the threaded portion 51 of the end closure central bore. The retainer nut 67 has a shoulder portion 71 which engages the spool member 61, such that, as the retainer nut 67 is threaded onto the end closure 39, the spool member 61 is moved in the direction toward the seat member 53. The transverse cross-section area of the seat member central bore first portion 57 is made larger than that of the spool member first portion 63, with the difference in these transverse cross-section areas being made substantially equal to the total transverse cross-section area of the electrical conductor wires 73 (including their insulation) that are to be passed through the end closure 39.

Figure 5:
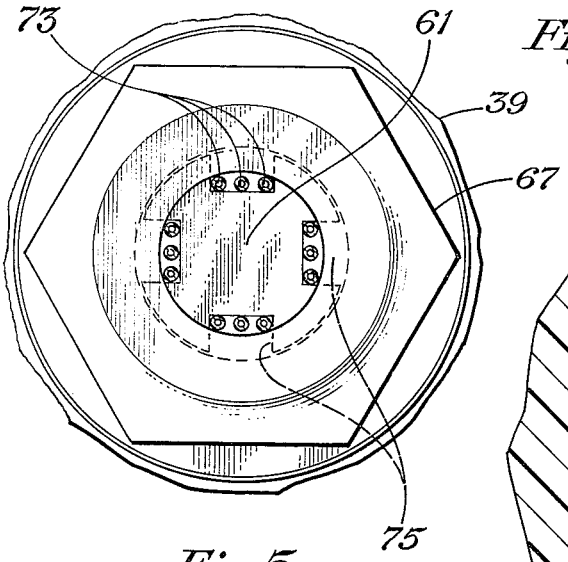
FIG. 5 is a fragmentary end view of a portion of FIG. 3.

The spool member 61 has a plurality of slots 75 disposed about the periphery of an outer end portion 77 that extends outwardly beyond the tapered portion 65. Each slot 75 receives a plurality of conductor wires 73, thus aiding the distribution of conductor wires about the spool member 61 (see FIG. 5).

Figure 4:
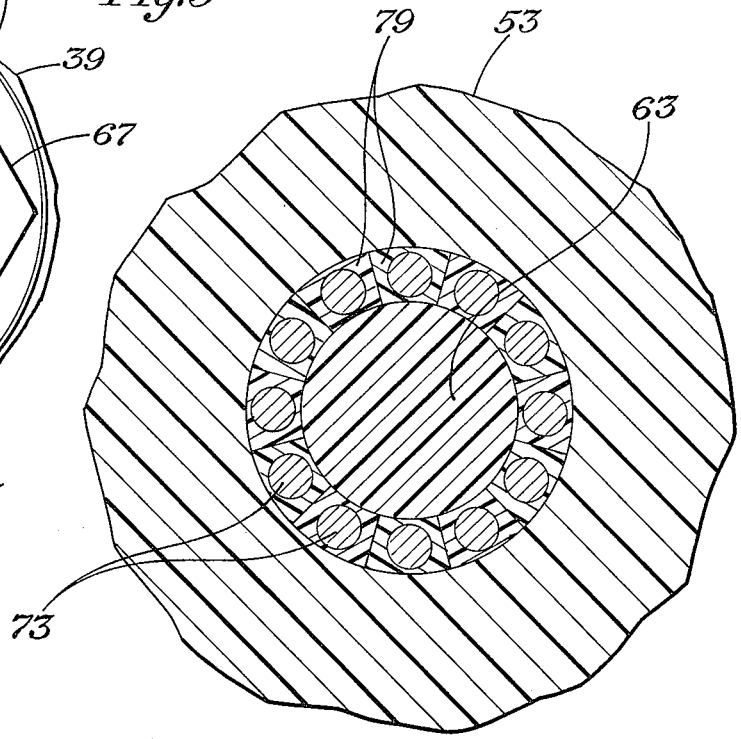
FIG. 4 is a transverse section view taken at line 4—4 of FIG. 3.

When typical selective firing units are used (like those disclosed in my U.S. Pat. No. 3,768,408), each selective firing unit will serve to ignite the shaped charge unit or units in ten chambers. For this purpose, a total of 12 conductor wires are needed, two of which are control wires. It is convenient to pass all twelve wires through the end closures of each chamber throughout the tool, so that the seat members and spool members can be a standard size. When the spool member 61 is sufficiently advanced toward the seat member 53 by the threading action of the retainer nut 67, the insulation 79 of the conductor wires 73 will be compressed and deformed such that the conductor wires will sealingly occupy the space between the mating surfaces of the seat member 53 and spool member 61, as illustrated by FIG. 4.

The mating tapered portions 59, 65 of the seat member 53 and spool member 61 provide additional gripping of the conductor wires 73, particularly to prevent slippage of the wires under pressure. These tapered portions also insure that the spool member will not be pushed through the seat member when subjected to pressure from below. These tapered portions are shown as conveniently straight in FIG. 3, but could, of course, have other shapes that would accomplish the desired results. The angle of these tapered portions with relation to the central axis is preferably within the range of 25°–35°. An angle of 30 degrees has been found in practice to be satisfactory. Also, though conveniently circular in transverse cross-section as shown in the drawings, the central bores of the seat member and spool member could have other shapes that would accomplish the desired results.

It is preferable that the end closures 39 be made of the type steel is commonly used for the tool sidewalls 37. It is also preferable that the seat member and spool member be made of an insulating material, for example, Delrin. The retainer nut material is preferably a metal, for example, the same type of metal that is commonly used for the port plugs that are threaded into the sidewall 37 at each shaped charge location.

It will be apparent from the foregoing that the present invention provides improved chamber isolator and sealing means for borehole perforating tools. More specifically, the chamber isolator or end closure of the invention is relatively inexpensive to manufacture, occupies relatively small space (the total length does not exceed the length of respective threaded joint in the embodiment shown), and can be quickly and easily assembled. The invention provides simple and effective arrangements for disposition and sealing of the pertinent electrical conductor wires.

The foregoing disclosure and the showings made in the drawings are merely illustrative of the principles of this invention and are not to be interpreted in a limiting sense.

What is claimed is:

1. In a borehole perforating tool of the type wherein there are provided a plurality of chambers with each chamber containing one or more shaped charge units and with each chamber having a cylindrical sidewall which is a part of the tool body and is threaded at its ends portions the improvement comprising:

(a) chamber end closures each having a peripheral flange portion that is clamped in the threaded joint when the sidewalls of adjacent chambers are threadedly joined, with the clamping action of said adjacent sidewalls on said flange portion being the sole means of retaining said end closures in position between said respective sidewalls.

2. The device of claim 1 wherein the total length of a respective said end closure does not exceed the length of a respective said threaded joint.

3. The device of claim 1 wherein the chamber end closures incorporate means permitting the passage of electrical conductor wires therethrough and means sealing the space between the conductors and respective end closure to effectively isolate the chamber.

4. The device of claim 3 wherein a respective said end closure has the general shape of a disc having an integral hub protruding on one side of the disc and said sealing means is contained within said hub.

5. In a borehole perforating tool of the type wherein there are provided a plurality of chambers with each chamber containing one or more shaped charge units and with each chamber having a cylindrical sidewall which is a part of the tool body and is threaded at its end portions, the improvement comprising:

(a) chamber end closures each having a peripheral flange portion that is clamped in the threaded joint when the sidewalls of adjacent chambers are threadedly joined; each end closure being provided:

(i) a central bore having an electrical conductor wire passage portion merging with an enlarged seat receiving portion which in turn merges with a threaded portion;

(ii) a seat member having a portion shaped to conformingly engage said end closure seat receiving portion and having a central bore, with said central bore having a first portion of constant transverse cross-secton area merging with a tapered portion;

(iii) a spool member having a first portion shaped to mate with said seat member central bore first portion and merging with a tapered portion shaped to mate with said seat member central bore tapered portion;

(iv) a retainer nut having a threaded portion engaging the threaded portion of said end closure central bore and having a shoulder portion engaging said spool member, such that as said retainer nut is threaded onto said end closure, said spool member is moved in the direction toward said seat member;

(v) a difference in the transverse cross-section areas of said seat member central bore first portion and said spool member first portion being made substantially equal to the total transverse cross-section area of a predetermined number of electrical conductor wires including their insulation;

(vi) whereby, when said predetermined number of conductor wires are passed through said end closure, being distributed about the periphery of said spool member, and when said spool member is sufficiently advanced toward said seat member by the threading action of said retainer nut, said conductor wires and their insulation will be compressed and deformed so as to sealingly occupy the space between mating surfaces of said seat member and said spool member.

6. The device of claim 5 wherein said seat member and said spool member are made of insulating material.

7. The device of claim 5 wherein the taper of said seat member and spool member is within the range of 25-35 degrees.

8. The device of claim 5 wherein the taper of said seat member and spool member is substantially 30 degrees.

9. The device of claim 5 wherein said spool member is provided a plurality of slots disposed about the periphery of an outer end portion which extends outwardly beyond said tapered portion, said slots being adapted for receiving and aiding the distribution of conductor wires about said spool member.

10. In a borehole perforating tool of the type wherein there are provided a plurality of chambers, with each chamber containing one or more shaped charge units and with each chamber having a cylindrical sidewall which is a part of the tool body and wherein each chamber has end closures, the improvement comprising:

(a) each end closure is provided a central bore having an electrical conductor wire passage portion merging with an enlarged seat receiving portion which in turn merges with a threaded portion;

(b) a seat member having a portion shaped to conformingly engage said end closure seat receiving portion and having a central bore, with said central bore having a first portion of constant transverse cross-section area merging with a tapered portion;

(c) a spool member having a first portion shaped to mate with said seat member central bore first portion and merging with a tapered portion shaped to mate with said seat member central bore tapered portion;

(d) a retainer nut having a threaded portion engaging the threaded portion of said end closure central bore and having a shoulder portion engaging said spool member, such that as said retainer nut is threaded onto said end closure, said spool member is moved in the direction toward said seat member;

(e) a difference in the transverse cross-section areas of said seat member central bore first portion and said spool member first portion being made substantially equal to the total transverse cross-section area of a predetermined number of electrical conductor wires including their insulation;

(f) whereby, when said predetermined number of conductor wires are passed through said end closure, being distributed about the periphery of said spool member, and when said spool member is sufficiently advanced toward said seat member by the threading action of said retainer nut, said conductor wires and their insulation will be compressed and deformed so as to sealingly occupy the space between mating surfaces of said seat member and said spool member.

11. In a borehole perforating tool of the type wherein there are provided a plurality of chambers, with each chamber containing one or more shaped charge units and with each chamber having a cylindrical sidewall which is a part of the tool body and is threaded at its end portions, the improvement comprising:

(a) the said threaded end portions of adjacent chambers are respectively male and female, with the extreme end of the male threaded portion and the inner end of the female threaded portion forming shoulders, so that a recess is formed by said shoulders when the sidewalls of adjacent chamber are threadedly joined;

(b) chamber end closures, each having a peripheral flange portion that is retained within said recess when the sidewalls of adjacent chambers are threadedly joined, with said recess being the sole means retaining a said respective chamber end closure.

12. The device of claim 11 wherein the total length of a respective said end closure does not exceed the length of a respective said threaded joint.

13. The device of claim 11 wherein the chamber end closures incorporate means permitting the passage of electrical conductor wires therethrough and means sealing the space between the conductors and respective end closure to effectively isolate the chamber.

14. The device of claim 13 wherein a respective said end closure has the general shape of a disc having an integral hub protruding on one side of the disc and said

15. In a borehole perforating tool of the type wherein there are provided a plurality of chambers, with each chamber containing one or more shaped charge units and with each chamber having a cylindrical sidewall which is a part of the tool body and is threaded at its end portions, the improvement comprising:

(a) the said threaded end portions of adjacent chambers are respectively male and female, with the extreme end of the male threaded portion and the inner end of the female threaded formed by said shoulders when the sidewalls of adjacent chamber are threadedly joined;

(b) chamber end closures, each having a peripheral flance portion that is retained within said recess when the sidewalls of adjacent chambers are threadedly joined, each end closure being provided:

(i) a central bore having an electrical conductor wire passage portion merging with an enlarged seat receiving portion which in turn merges with a threaded portion;

(ii) a seat member having a portion shaped to conformingly engage said end closure seat receiving portion and having a central bore, with said central bore having a first portion of constant transverse cross-section area merging with a tapered portion;

(iii) a spool member having a first portion shaped to mate with said seat member central bore first portion and merging with a tapered portion shaped to mate with said seat member central bore tapered portion;

(iv) a retainer nut having a threaded portion engaging the threaded portion of said end closure central bore and having a shoulder portion engaging said spool member, such that as said retainer nut is threaded onto said end closure, said spool member is moved in the direction toward said seat member;

(v) a difference in the transverse cross-section areas of said seat member central bore first portion and said spool member first portion being made substantially equal to the total transverse cross-section area of a predetermined number of electrical conductor wires including their insulation;

(vi) whereby, when said predetermined number of conductor wires are passed through said end closure, being distributed about the periphery of said spool member, and when said spool member is sufficiently advanced toward said seat member by the threading action of said retainer nut, said conductor wires and their insulation will be compressed and deformed so as to sealingly occupy the space between mating surfaces of said seat member and said spool member.

* * * * *